US007438565B2

(12) United States Patent
Hamazaki

(10) Patent No.: US 7,438,565 B2
(45) Date of Patent: Oct. 21, 2008

(54) CONNECTOR

(75) Inventor: Masahiro Hamazaki, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/407,359

(22) Filed: Apr. 20, 2006

(65) Prior Publication Data

US 2007/0072457 A1 Mar. 29, 2007

(30) Foreign Application Priority Data

Sep. 26, 2005 (JP) ..... 2005-277872

(51) Int. Cl.
*H01R 4/66* (2006.01)

(52) U.S. Cl. ..... 439/108; 439/497; 439/610

(58) Field of Classification Search ..... 439/610, 439/947, 98, 108, 76.1, 579, 497
See application file for complete search history.

(56) References Cited

U.S. PATENT DOCUMENTS 6,319,040 B1 * 11/2001 Chang ..... 439/352
6,328,588 B1 * 12/2001 Tsai et al. ..... 439/352
6,565,366 B1 * 5/2003 Wu ..... 439/76.1
6,619,987 B2 * 9/2003 Kumamoto et al. ..... 439/610
6,685,511 B2 * 2/2004 Akama et al. ..... 439/610
6,739,904 B2 * 5/2004 Wu ..... 439/497
6,764,342 B2 * 7/2004 Murayama et al. ..... 439/608
6,786,763 B2 * 9/2004 Wu ..... 439/497
6,890,189 B1 * 5/2005 Wu ..... 439/76.1
7,101,188 B1 * 9/2006 Summers et al. ..... 439/59
7,131,862 B2 * 11/2006 Vermeersch ..... 439/497

FOREIGN PATENT DOCUMENTS

JP 2003-59593 2/2003

* cited by examiner

*Primary Examiner*—Tho D. Ta
*Assistant Examiner*—Travis Chambers
(74) *Attorney, Agent, or Firm*—Staas & Halsey LLP

(57) ABSTRACT

A connector comprises: a shield cover; a connector module housed in the shield cover; an insertion portion disposed at a tip thereof, the insertion portion being configured to be inserted into a destination connector and having signal contacts and ground contacts arranged; and a cable extending from a rear end of the connector. The connector module includes a printed board, the signal contacts, and the ground contacts. The printed board includes signal and ground patterns on front and rear faces, the signal pattern having pads for signal contacts and the ground pattern having pads for ground contacts. The signal contacts are formed based on the pads for signal contacts and fixed on the pads for signal contacts. The ground contacts are formed based on the pads for ground contacts and fixed on the pads for ground contacts. The insertion portion is formed at an end of the printed board.

5 Claims, 12 Drawing Sheets

CONNECTOR

BACKGROUND OF THE INVENTION

1. Field of the Invention

The present invention generally relates to a connector and especially to a cable side connector disposed at an end of a cable.

2. Description of the Related Art

A cable side connector is connected to a board side connector mounted on an end of a printed board of an electronic device.

Today, regarding the cable side connector, it is required that the number of components thereof be reduced and a narrower pitch be supported.

FIG. 1 is a perspective view showing a conventional cable side connector 10 and a board side connector 40 for connecting thereto. The cable side connector 10 is disposed by connecting to an end of a cable 11 and is used by connecting to the board side connector 40 mounted on an end of a printed board 41 of an electric device.

The cable side connector 10 includes a connector module 12 disposed in a shield cover assembly 30.

As shown in FIG. 2, the connector module 12 includes a printed board 20 attached to a contact assembly 13.

As shown in FIG. 3, the contact assembly 13 includes, a pair of signal contacts 15-1 and 15-2, and a plate-like ground contact 16 press-fitted into a molded component 14 from the rear thereof. In the molded component 14, the signal contacts 15-1 and 15-2 and the ground contact 16 are arranged in a plate-like portion 14*a* protruding forward. This portion is configured to be an insert portion 18 and inserted into the board side connector 40. Terminal portions 15-1*a*, 15-2*a*, and 16*a* are arranged behind the molded component 14 in a protruding manner.

The printed board 20 includes a signal pattern 21 and a ground pattern 22 in an upper surface and a lower surface. The signal pattern 21 has plural lines arranged in parallel. The rest portion includes the ground pattern 22.

In the printed board 20, a front end thereof is fitted into a groove portion 14*b* of the molded component 14, ends of the signal pattern 21 are soldered with the terminal portions 15-1*a*, 15-2*a*, and an end of the ground pattern 22 is soldered with the terminal portion 16*a*.

Patent Document 1: Japanese Laid-Open Patent Application No. 2003-059593

The aforementioned cable side connector 10 requires the contact assembly 13, the printed board 20, and the shield cover assembly 30, so that many components are used.

The manufacturing of the contact assembly 13 requires a step for press-fitting multiple signal contacts 15-1 and 15-2 and ground contacts 16 into the molded component 14 and poses a problem in that the manufacturing is rather complicated.

The pitch of the contacts is determined in accordance with the forming accuracy of through-holes for the signal contacts and the ground contacts and of the groove portion in the molded component 14. However, when the pitch resulting from the through-holes and the groove portion is narrowed, the mechanical strength of the molded component 14 is reduced. In addition, a crack may be generated upon press-fitting the contacts, so that the molded component 14 is unsuitable for the narrowed pitch.

Further, the ground contact 16 has a press-cut surface as a contact surface and thus poses a problem in that insertion/withdrawal life is reduced.

SUMMARY OF THE INVENTION

It is a general object of the present invention to provide an improved and useful connector in which the above-mentioned problems are eliminated.

A more specific object of the present invention is to provide a connector that has a reduced number of components and improved transmission characteristics.

In light of this, the present invention provides a connector comprising: a shield cover; a connector module housed in the shield cover; an insertion portion disposed at a tip of the connector, the insertion portion being configured to be inserted into a destination connector and having signal contacts and ground contacts arranged; and a cable extending from a rear end of the connector. The connector module includes a printed board, the signal contacts, and the ground contacts. The printed board includes a signal pattern and a ground pattern on a front face and a rear face thereof, the signal pattern having pads for signal contacts at an end thereof and the ground pattern having pads for ground contacts at an end thereof. The signal contacts are formed in accordance with the pads for signal contacts and fixed on the pads for signal contacts. The ground contacts are formed in accordance with the pads for ground contacts and fixed on the pads for ground contacts. And the insertion portion is formed at an end of the printed board.

According to the present invention, the connector module is housed in the shield cover and the connector module includes the printed board, the signal contacts, and the ground contacts. Thus, the number of the components of the connector is reduced in comparison with a conventional connector and manufacturing thereof is easy. Further, the insertion portion is formed at the end of the printed board, so that impedance matching can be readily achieved at the insertion portion and good high-speed transmission characteristics are provided.

Other objects, features and advantage of the present invention will become more apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 4:
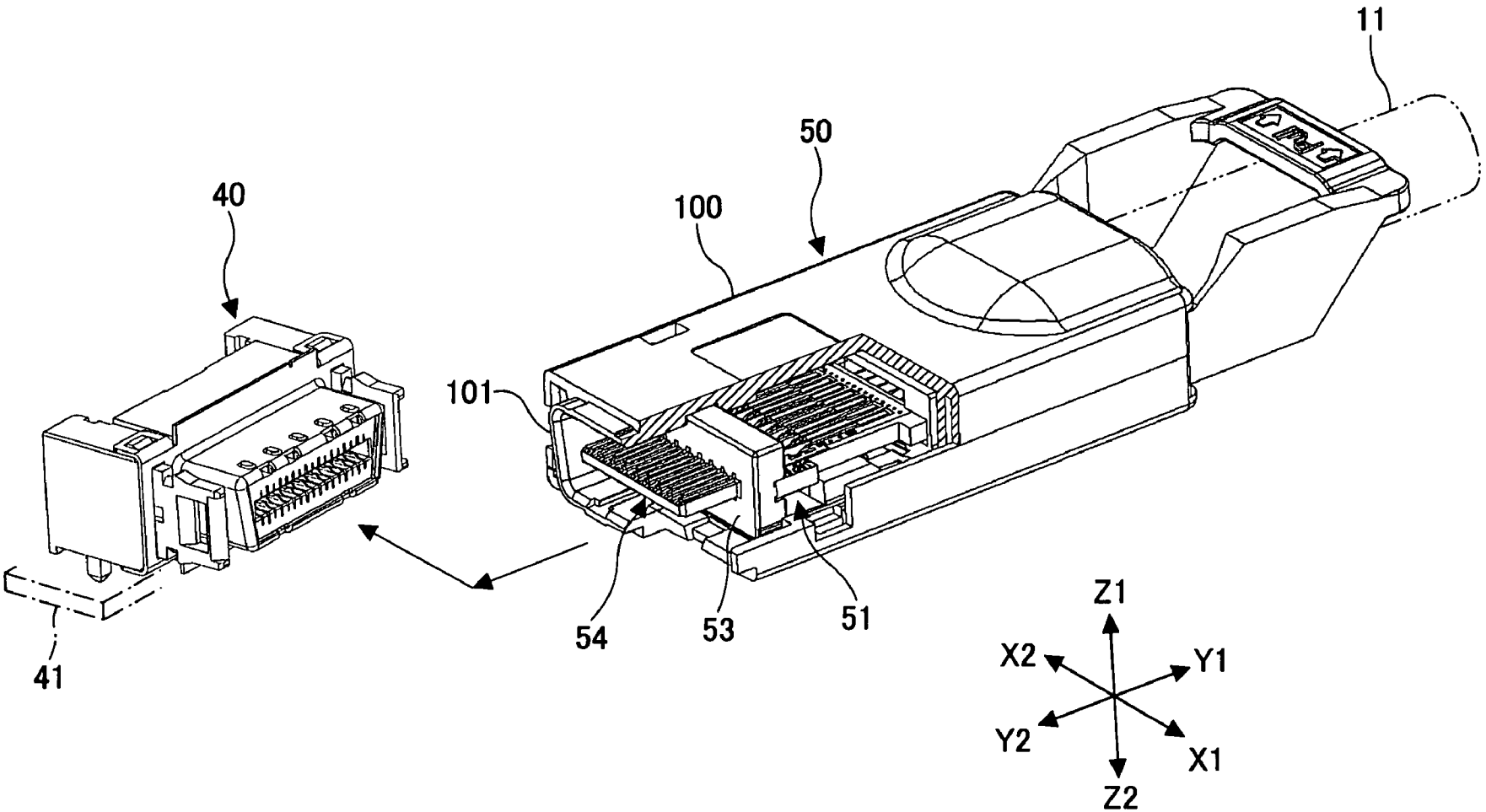
FIG. 4 is a perspective view showing a cable side connector according to embodiment 1 of the present invention and a board side connector for connecting thereto.

FIG. 4 is a perspective view showing a cable side connector 50 according to embodiment 1 of the present invention and a board side connector 40 for connecting thereto. The cable side connector 50 is disposed by connecting to an end of the cable 11 extending from a Y1 direction. The cable side connector 50 is used by connecting to the board side connector 40 mounted on an end of a printed board 41 of an electric device. The cable 11 includes plural paired wires and drain wires embedded in the inside thereof.

X1-X2, Y1-Y2, and Z1-Z2 indicate a width direction, a longitudinal direction, and a height direction of the cable side connector 50, respectively. Y1 indicates the rear and Y2 indicates the front (an insertion direction upon connection).

The cable side connector 50 includes a connector module 51 embedded in a shield cover assembly 100. An insertion portion 54 protrudes from an opening 101 at a tip (Y2 side) of the shield cover assembly 100.

(Structure of the Connector Module 51)

Figure 1:
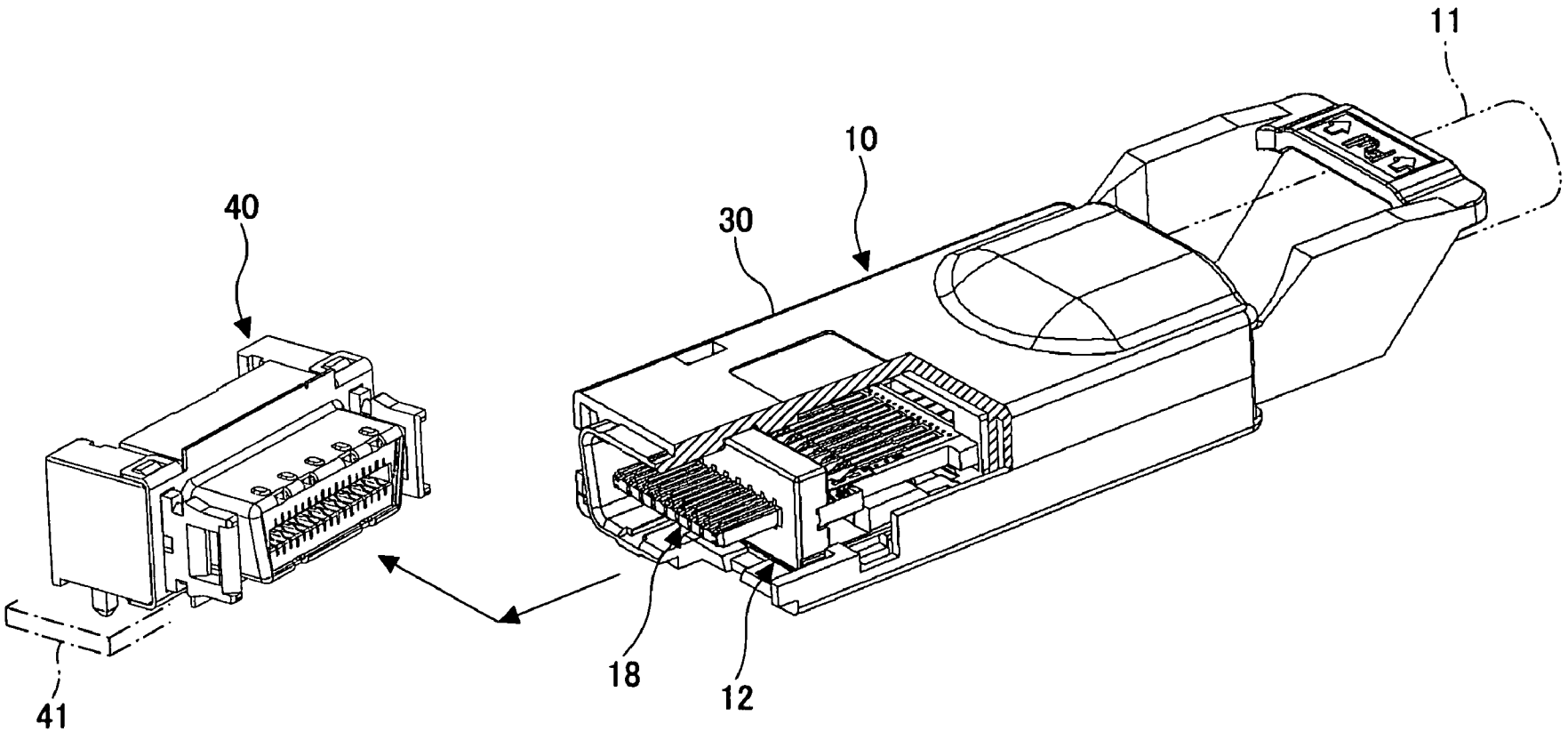
FIG. 1 is a perspective view showing a conventional cable side connector and a board side connector for connecting thereto.
Figure 2:
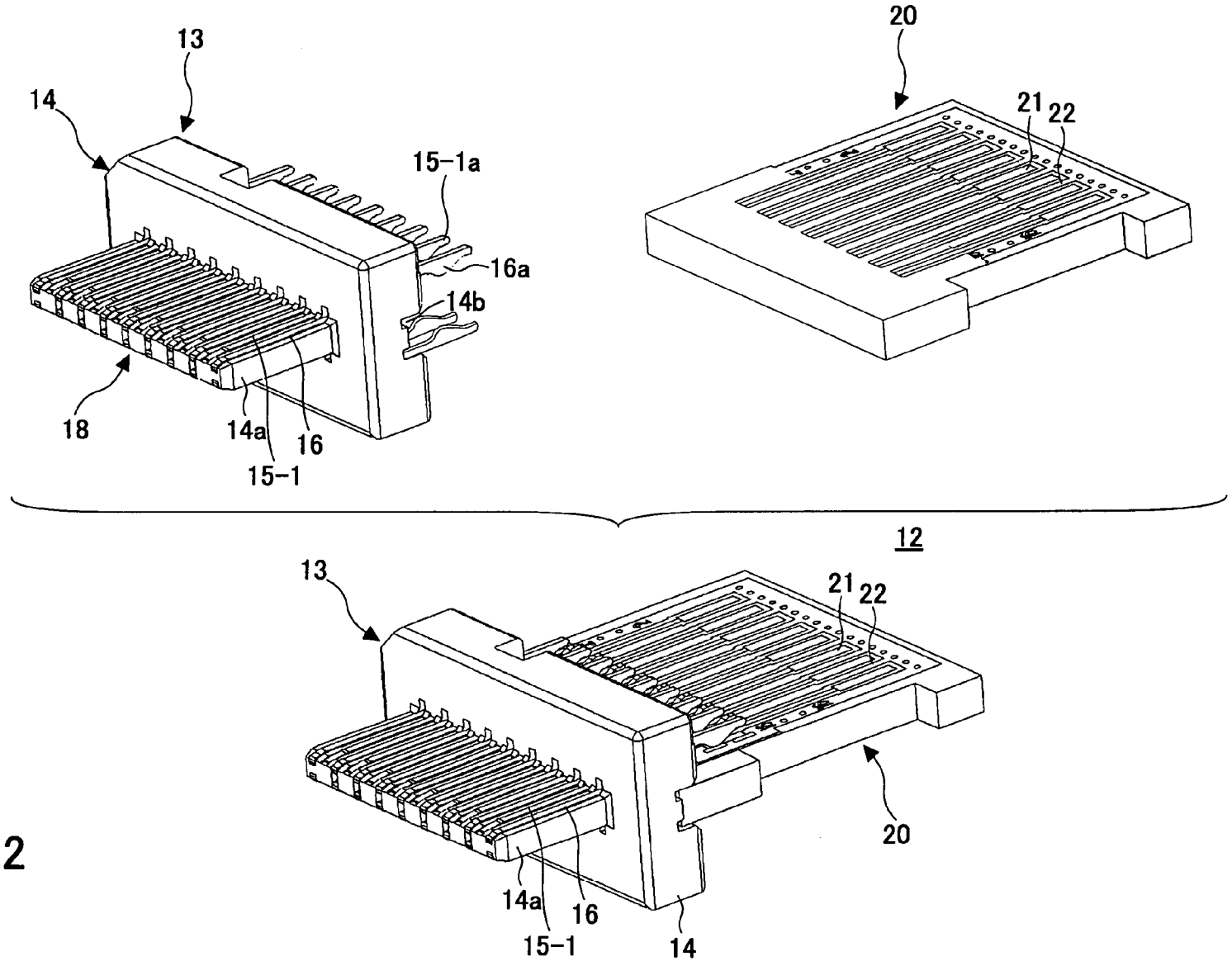
FIG. 2 is a perspective view showing a connector module constituting the cable side connector in FIG. 1.
Figure 3:
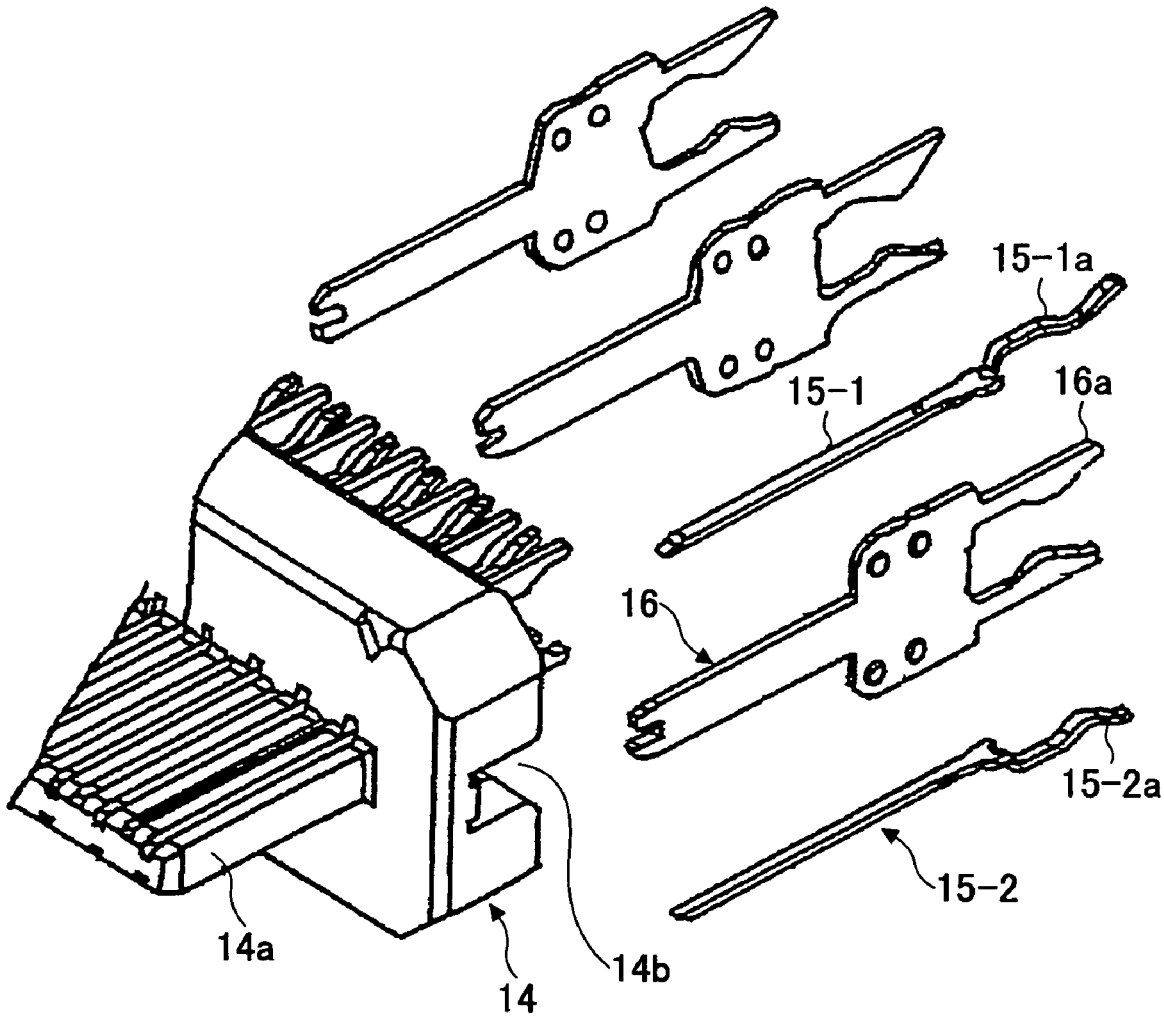
FIG. 3 is an exploded perspective view showing a contact assembly constituting the connector module in FIG. 2.
Figure 5:
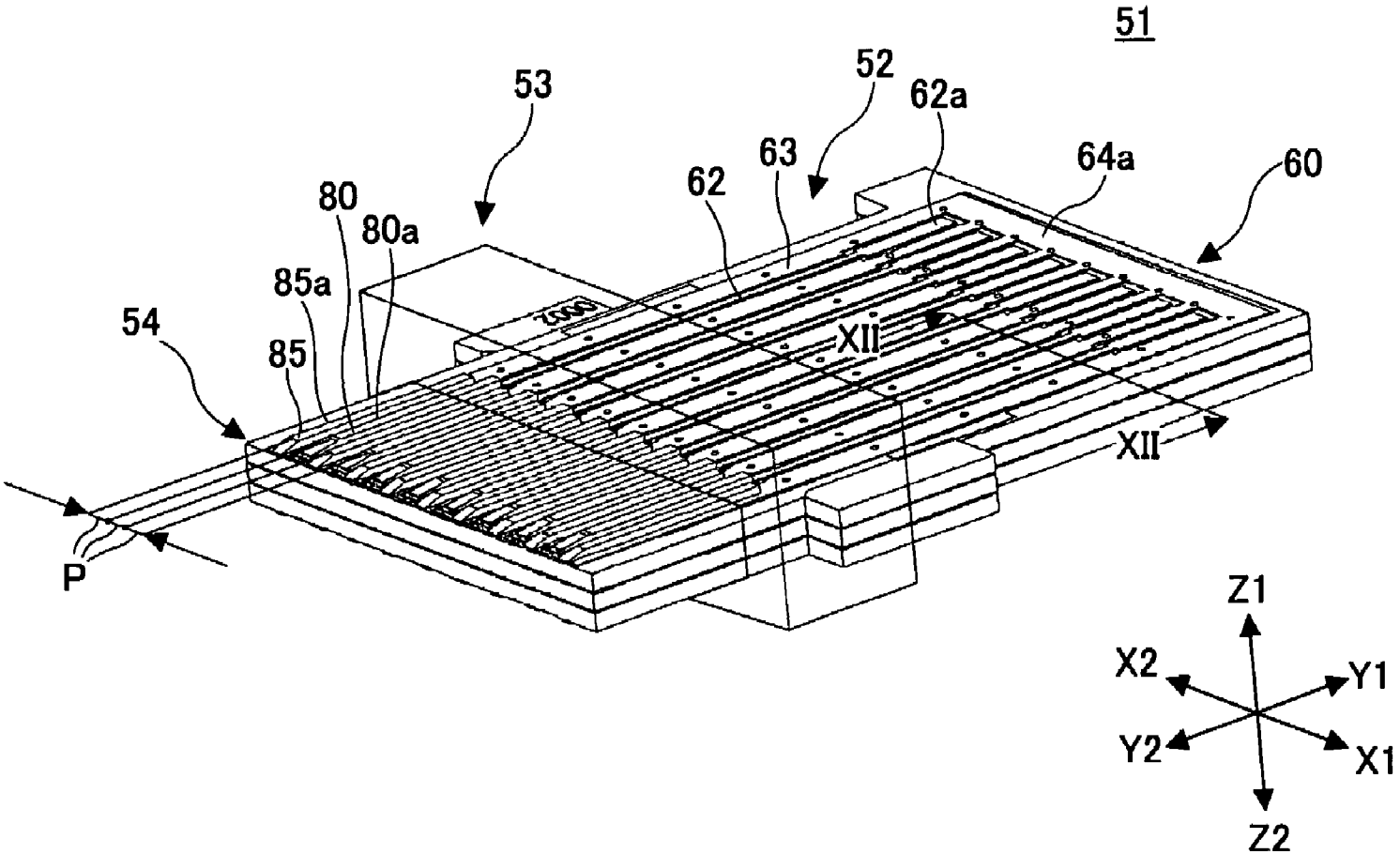
FIG. 5 is a perspective view showing a connector module constituting the cable side connector in FIG. 4.

As shown in FIG. 5, the connector module 51 includes a printed board module 52 where a resin portion 53 is formed in a flange shape by outsert molding. The connector module 51 has the same size as that of the connector module 12 shown in FIG. 2. A portion from the resin portion 53 on the Y2 side is the insertion portion 54. In FIG. 5, for ease of understanding, the resin portion 53 is shown in a framework. The resin portion 53 may be formed by potting.

(Structure of the Printed Board Module 52)

Figure 6:
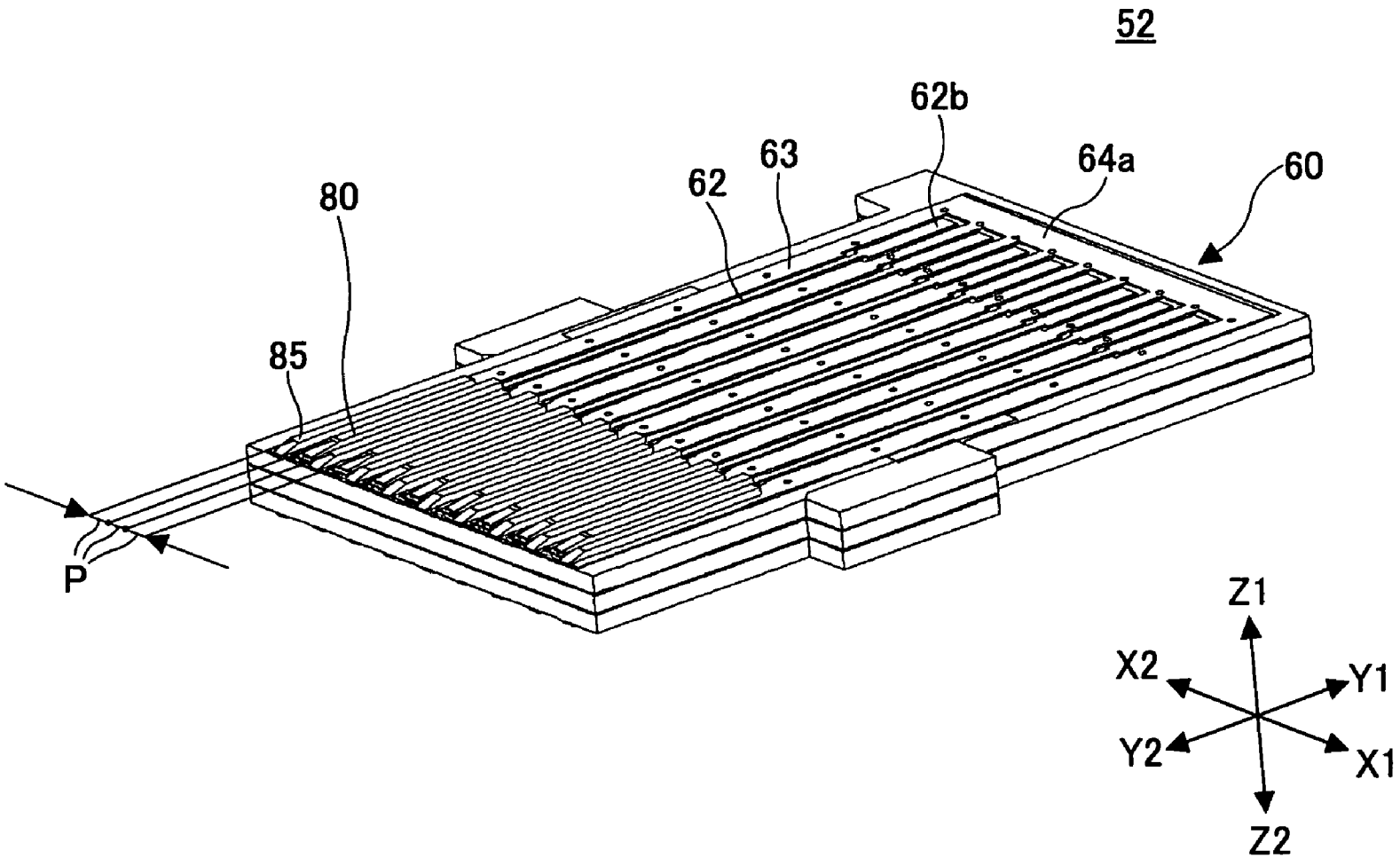
FIG. 6 is a perspective view showing a printed board module.
Figure 7:
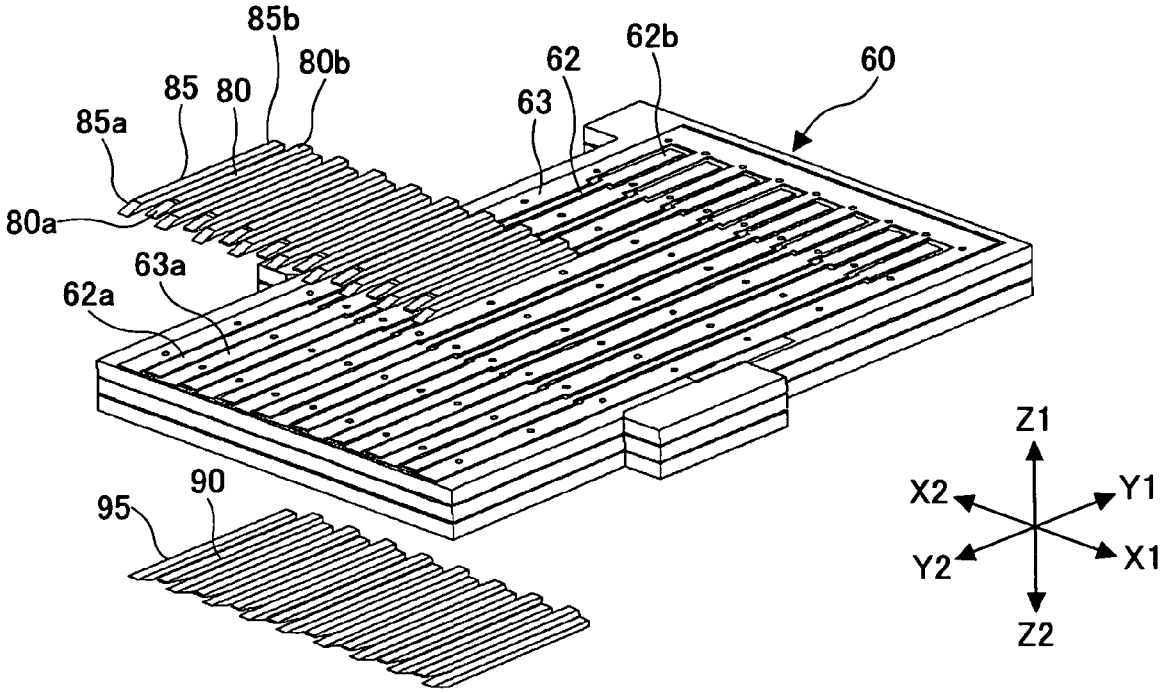
FIG. 7 is an exploded perspective view showing a printed board module.
Figure 8:
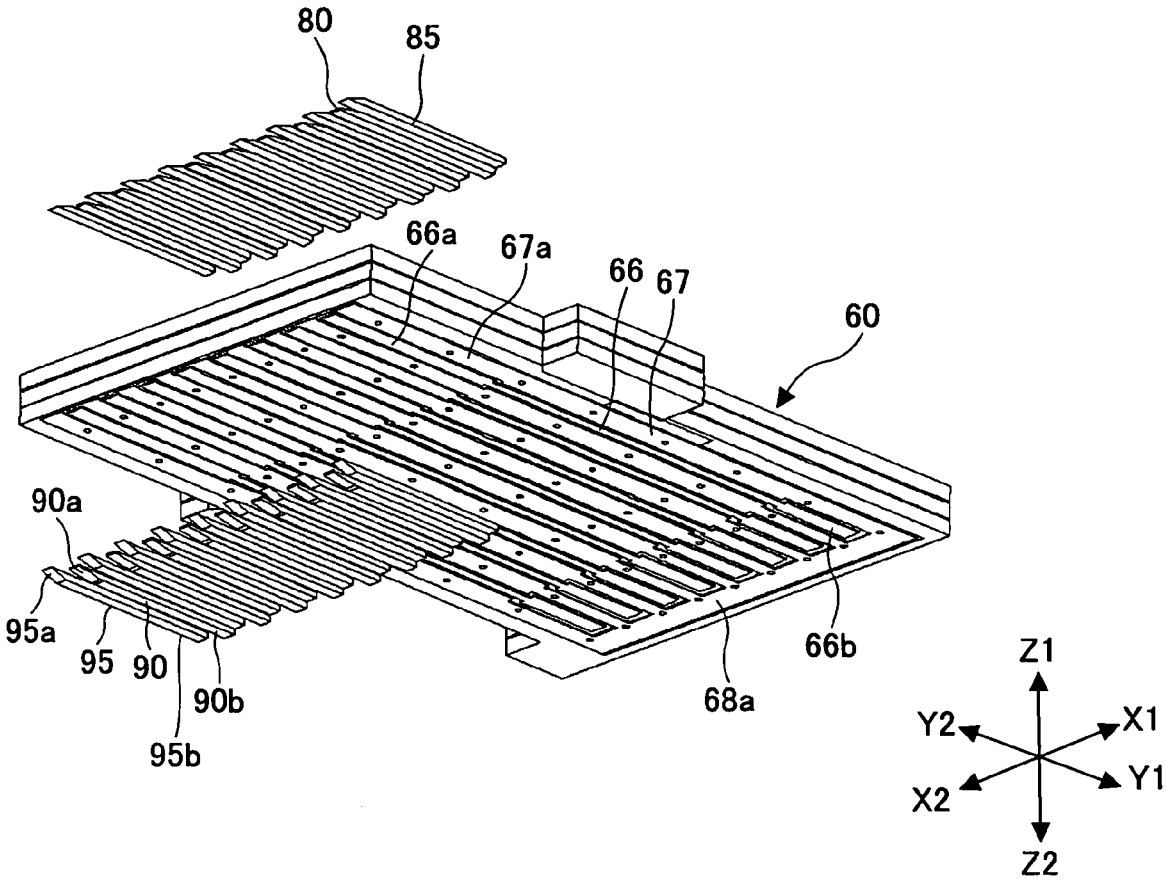
FIG. 8 is an exploded perspective view showing a printed board module when viewed from below.

FIG. 6 is a perspective view showing the printed board module 52. As shown in FIGS. 7 and 8, the printed board module 52 includes a printed board 60 where signal contacts 80 and 90 and ground contacts 85 and 95 are fixed.

Figure 9A:
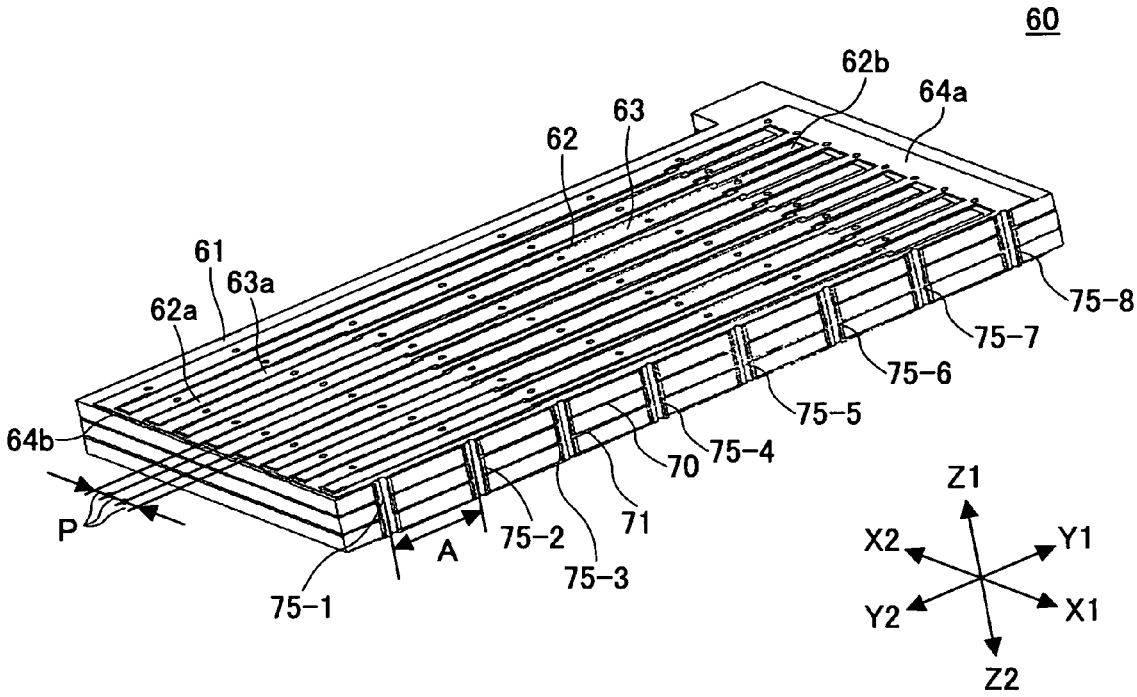
FIG. 9A is a perspective view showing a partly sectioned print board when viewed from above.
Figure 9B:
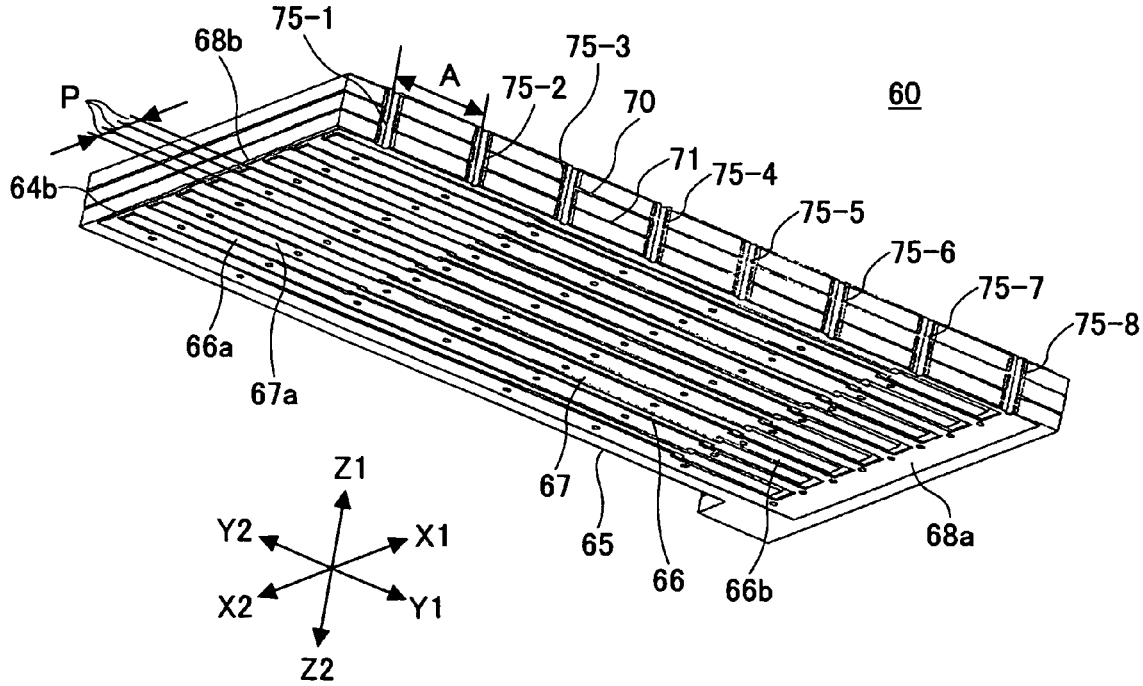
FIG. 9B is a perspective view showing a partly sectioned print board when viewed from below.
Figure 10:
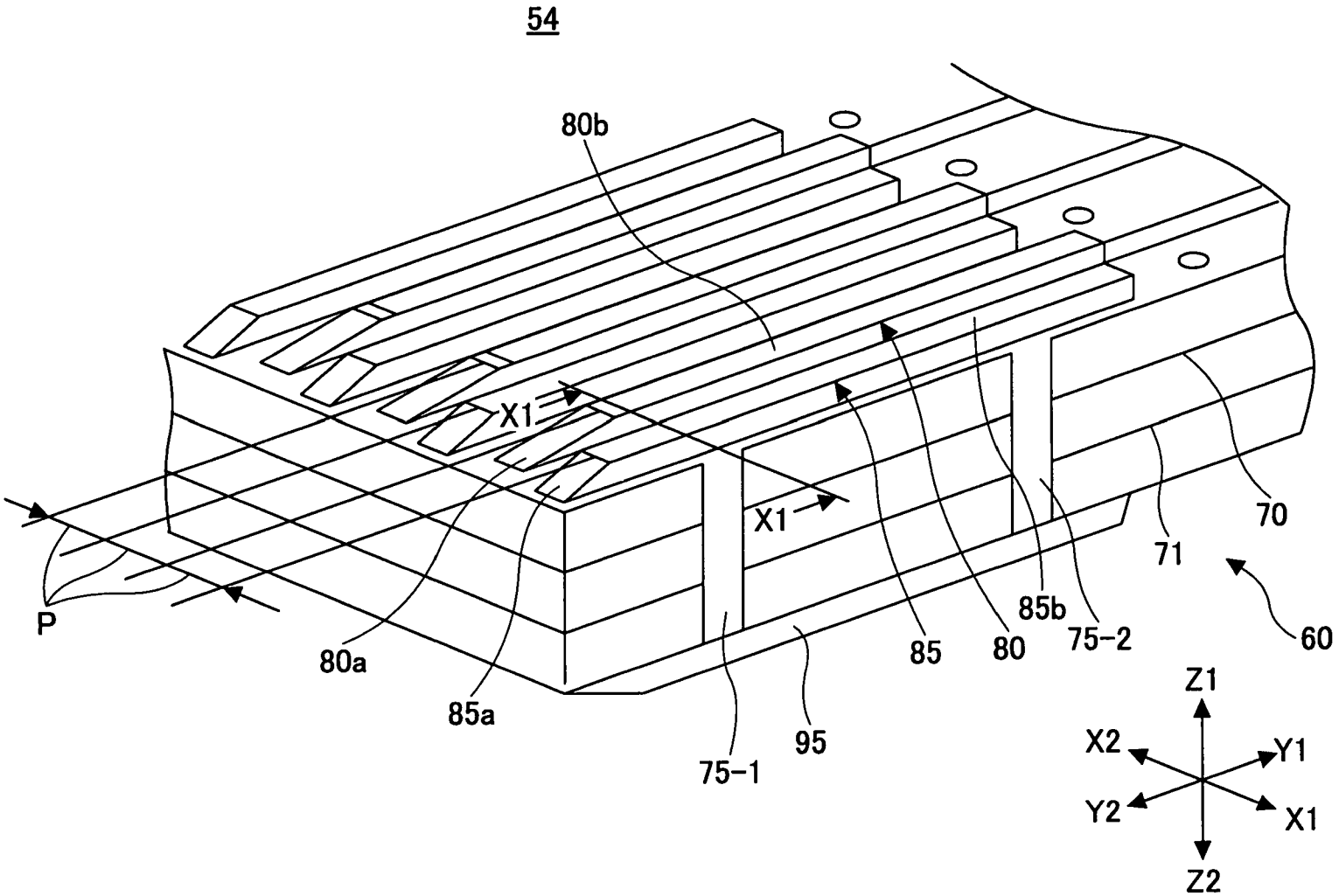
FIG. 10 is an enlarged perspective view showing an insertion portion.
Figure 11:
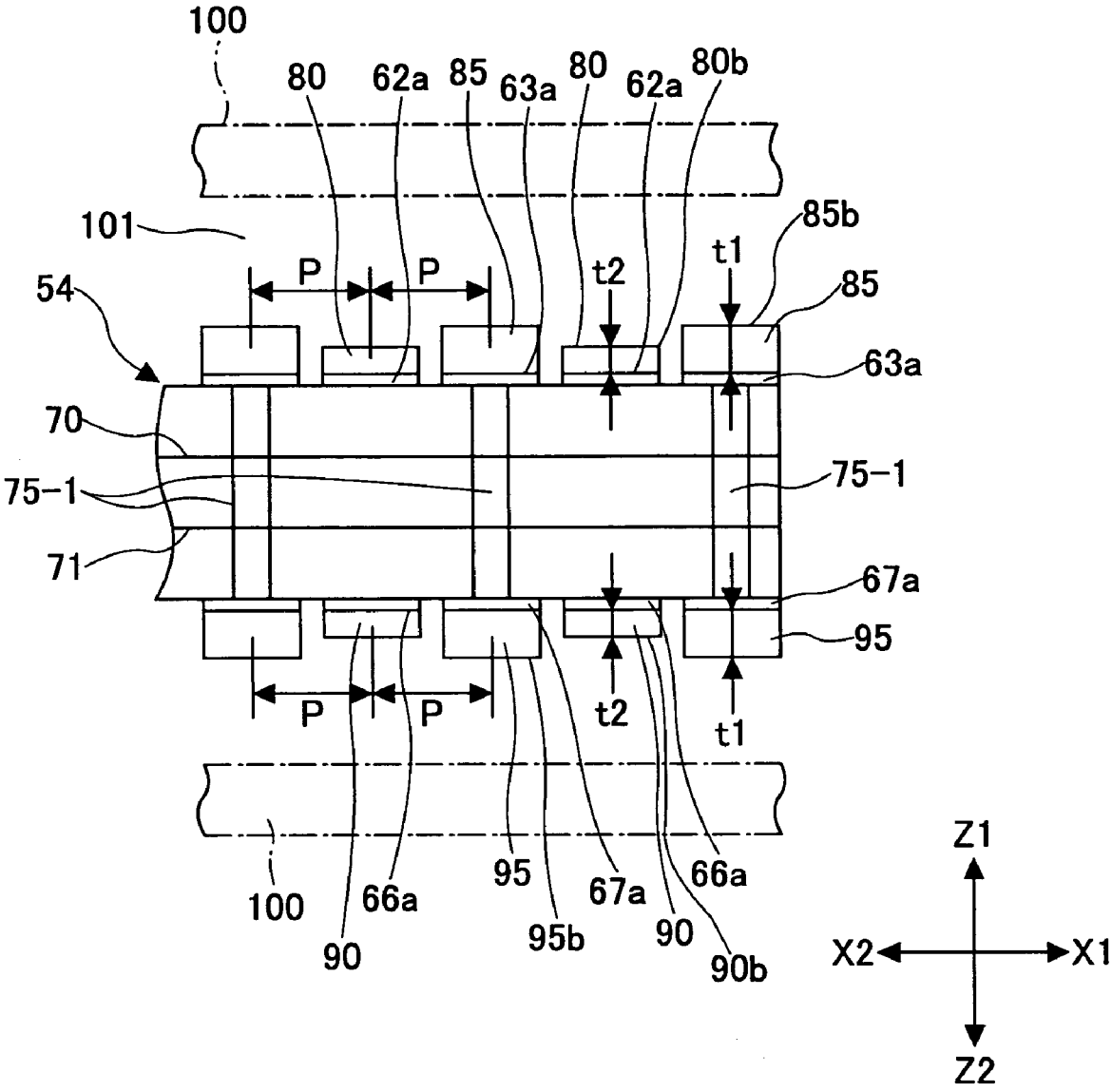
FIG. 11 is a cross-sectional view showing an X-Z surface taken along line XI-XI in FIG. 10.

As shown in FIGS. 9A and 9B, the printed board 60 is a four-layer board having a signal pattern 62 and a ground pattern 63 in an upper surface 61. Also, a signal pattern 66 and a ground pattern 67 are formed in a lower surface 65 in the same manner. Further, two solid inner ground layers 70 and 71 and multiple vias 75-1 to 75-8 are disposed in the printed board 60.

Lines of the signal pattern 62 and the signal pattern 66 are both elongated in the Y direction and arranged in parallel in the X direction. The lines of the signal pattern 62 and the signal pattern 66 are positioned in a corresponding manner in terms of the Z direction.

As shown in FIG. 9A, lines of the ground pattern 63 are elongated in the Y direction between adjacent lines of the signal pattern 62 and arranged in parallel in the X direction. Ends of the lines of the ground pattern 63 in the Y1 direction are linked at a band-like portion 64*a* and ends of the lines of the ground pattern 63 in the Y2 direction are linked at a band-like portion 64*b*. In other words, the ground pattern 63 has rectangular patterns arranged in the X direction, the rectangular patterns being elongated in the Y direction. The ground pattern 63 surrounds each of the lines of the signal pattern 62.

As shown in FIG. 9B, lines of the ground pattern 67 are elongated in the Y direction between adjacent lines of the signal pattern 66 and arranged in parallel in the X direction. Ends of the lines of the ground pattern 67 in the Y1 direction are linked at a band-like portion 68*a* and ends of the lines of the ground pattern 67 in the Y2 direction are linked at a band-like portion 68*b*. In other words, the ground pattern 67 has rectangular patterns arranged in the X direction, the rectangular patterns being elongated in the Y direction. The ground pattern 67 surrounds each of the lines of the signal pattern 66.

The lines of the ground pattern 63 and the ground pattern 67 are positioned in a corresponding manner in terms of the Z direction.

The vias 75-1 to 75-8 are arranged in the Y direction with a pitch of Q and disposed between the ground pattern 63 and the ground pattern 67. Ends of the vias in the Z1 direction are connected to the ground pattern 63 and ends of the vias in the Z2 direction are connected to the ground pattern 67. Portions between aforementioned ends are connected to the inner ground layers 70 and 71. The value of the pitch Q is determined such that it has a shielding effect against signals of up to a predetermined frequency.

The signal pattern 62 and the signal pattern 66 have pads 62*a* and 66*a* for signal contacts on the Y2 side and pads 62*b* and 66*b* for signal wires on the Y1 side, respectively. The pads 62*a* and 66*a* for signal contacts are positioned in a corresponding manner in terms of the Z direction.

The ground pattern 63 and the ground pattern 67 have pads 63*a* and 67*a* for ground contacts on the Y2 side, respectively. The pads 63*a* and 67*a* for ground contacts are positioned in a corresponding manner in terms of the Z direction.

The vias 75-1 and 75-2 connect the pads 63*a* and 67*a* for ground contacts to the inner ground layers 70 and 71 (the distance between the vias 75-1 and 75-2 in the Y direction is A).

On the upper surface 61 of the printed board 60, the pads 62*a* for signal contacts and the pads 63*a* for ground contacts are arranged with a pitch of P. On the lower surface 65 of the printed board 60, the pads 66*a* for signal contacts and the pads 67*a* for ground contacts are arranged with the pitch P.

It is not difficult to narrow the pitch P and it is not difficult to reduce the sizes of the signal contacts 80 and 90 and ground contacts 85 and 95. Further, it is not difficult to mount the signal contacts 80 and 90 and ground contacts 85 and 95 on the pads when the sizes thereof are reduced. Thus, this structure is capable of enabling a narrower pitch.

As shown in FIGS. 7 and 8, the signal contacts 80 on the upper surface and the ground contacts 85 on the upper surface are formed by punching or etching a metallic plate material and each has a long and narrow form in accordance with the forms of the pads 62*a* for signal contacts and the pads 63*a* for ground contacts. The signal contacts 80 on the upper surface and the ground contacts 85 on the upper surface have inclined planes 80*a* and 85*a* on the Y2 side. Upper surfaces 80*b* and 85*b* used as contact surfaces of the signal contacts 80 on the upper surface and the ground contacts 85 on the upper surface have rolled surfaces.

As shown in FIGS. 5, 6, 10, and 11, the signal contacts 80 on the upper surface are fixed on the pads 62*a* for signal contacts and the ground contacts 85 on the upper surface are fixed on the pads 63*a* for ground contacts by conductive adhesive or soldering. The signal contact 80 on the upper surface and the ground contact 85 on the upper surface are arranged with the pitch P.

As shown in FIG. 8, the signal contacts 90 on the lower surface and the ground contacts 95 on the lower surface are prepared by inverting the signal contacts 80 on the upper surface and the ground contacts 85 on the upper surface. The signal contacts 90 on the lower surface and the ground contacts 95 on the lower surface have inclined planes 90*a* and 95*a* on the Y2 side and rolled surfaces as lower surfaces 90*b* and 90*b*. The signal contacts 90 on the lower surface and the ground contacts 95 on the lower surface are fixed on the pads 66*a* for signal contacts and the pads 67*a* for ground contacts. The signal contacts 90 on the lower surface and the ground contacts 95 on the lower surface are arranged with the pith P.

In this manner, the insertion portion 54 is formed at an end of the printed board 60 on the Y2 side. The printed board module 52 includes the insertion portion 54 at the Y2 end thereof.

(Pseudo-coaxial Structure)

(1) (Pseudo-coaxial Structure of the Insertion Portion 54)

Each of the signal contacts 80 on the upper surface is shielded on the X1 and X2 sides using the ground contacts 85 on the upper surface and the vias 75-1 and 75-2, on the Z2 side using the inner ground layer 70, and on the Z1 side using the shield cover assembly 100, thereby having a pseudo-coaxial structure.

In this case, tips of the signal contacts 80 on the upper surface are slightly receded in the Y1 direction relative to tips of the ground contacts 85 on the upper surface. A thickness t1 of the ground contacts 85 on the upper surface is slightly greater than a thickness t2 of the signal contacts 80 on the upper surface. This enables good shielding on the X1 and X2 sides.

Each of the signal contacts 90 on the lower surface is shielded on the X1 and X2 sides using the ground contacts 95 on the lower surface and the vias 75-1 and 75-2, on the Z1 side using the inner ground layer 71, and on the Z2 side using the shield cover assembly 100, thereby having a pseudo-coaxial structure.

In the same manner as in the signal contacts 80 on the upper surface, tips of the signal contacts 90 on the lower surface are slightly receded in the Y1 direction relative to tips of the ground contacts 95 on the lower surface. The thickness t1 of the ground contacts 95 on the lower surface is slightly greater than the thickness t2 of the signal contacts 90 on the lower surface. This enables good shielding on the X1 and X2 sides.

(2) (Pseudo-coaxial Structure of the Signal Patterns 62 and 66)

Figure 12:
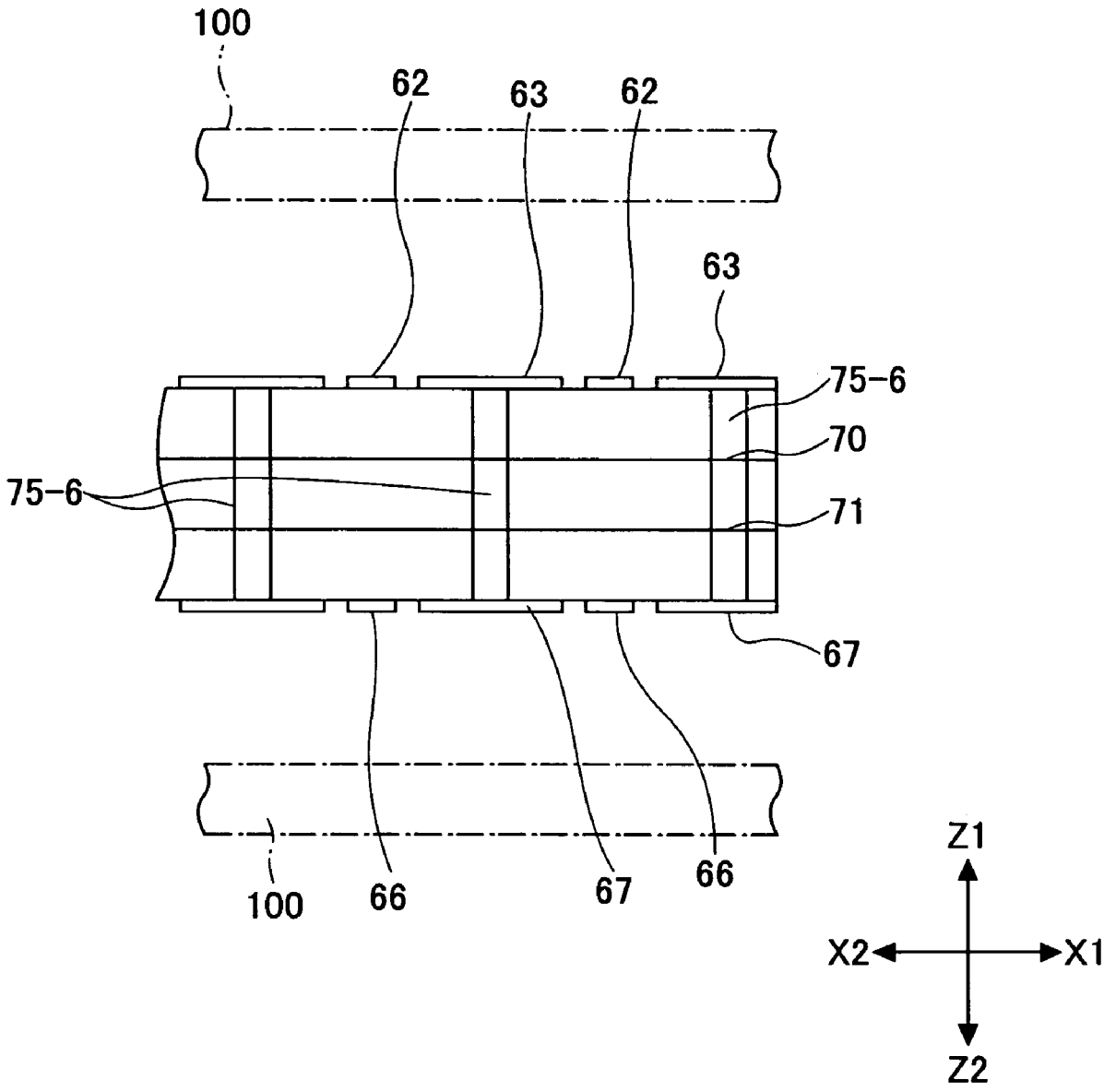
FIG. 12 is a cross-sectional view showing an X-Z surface taken along line XII-XII in FIG. 5.

As shown in FIG. 12, each of the lines of the signal pattern 62 is shielded on the X1 and X2 sides using the ground pattern 63 and the vias 75-3 to 75-8, on the Z2 side using the inner ground layer 70, and on the Z1 side using the shield cover assembly 100, thereby having a pseudo-coaxial structure.

As also shown in FIG. 12, each of the lines of the signal pattern 66 is shielded on the X1 and X2 sides using the ground pattern 67 and the vias 75-3 to 75-8, on the Z1 side using the inner ground layer 71, and on the Z2 side using the shield cover assembly 100, thereby having a pseudo-coaxial structure.

(More Specific Structure of the Cable Side Connector 50)

The cable side connector 50 includes the aforementioned connector module 51 embedded in the metallic shield cover assembly 100. The connector module 51 is positioned at the center of the shield cover assembly 100 using the resin portion 53. Signal wires extending from the end of the cable 11 are each soldered with the pads 62*b* and 66*b* for signal wires. In the same manner, drain wires extending from the end of the cable 11 are soldered with the ground patterns 63 and 67. The resin portion 53 also has a function of preventing the detachment of the contacts 80, 90, 85, and 95.

(Characteristics of the Cable Side Connector 50)

The cable side connector 50 has various characteristics below.

(1) Reduced Number of Components

The cable side connector 50 includes the connector module 51 and the shield cover assembly 100, so that the number of components is reduced in comparison with a conventional cable side connector.

(2) Easy to Assemble and Manufacture

The necessity to press-fit the contacts into a molded component is eliminated, so that the cable side connector 50 is easy to manufacture.

(3) Easy to Enable a Narrower Pitch

It is easy to narrow the pitch by reducing the widths of the pads 62*a* and 66*a* for signal contacts and the pads 63*a* and 67*a* for ground contacts. Further, the forms of the signal contacts 80 and 90 and the ground contacts 85 and 95 are simple and it is possible to reduce the widths therebetween. Thus, the cable side connector 50 is readily capable of enabling a narrower pitch.

(4) Longer Insertion/Withdrawal Life

The signal contacts 80 and 90 and the ground contacts 85 and 95 both have rolled surfaces for contacting the contacts on the board side connector 40. Thus, damage to the contact surfaces of each contact 80, 90, 85, and 95 accompanied by insertion/withdrawal is reduced and insertion/withdrawal life is improved.

(5) Good Impedance Matching

The signal patterns 62 and 66 cover the entire length of the connector module 51 in the Y direction and are elongated to the insertion portion 54. Thus, impedance matching is achieved in the entire length of the connector module 51 from an end on the Y1 side to the insertion portion 54 at an end on the Y2 side.

(6) Pseudo-coaxial Structure

In addition to the signal patterns 62 and 66, the signal contacts 80 and 90 at the insertion portion 54 have a pseudo-coaxial structure.

(7) Good High-speed Transmission Characteristics

Signal lines (including signal patterns and signal contacts) are capable of reducing noise generated in each signal line, since impedance matching is achieved in the entire length. Moreover, the signal lines have a pseudo-coaxial structure in the entire length and the thicknesses t1 of the ground contacts 85 and 95 are slightly greater than the thickness t2 of the signal contacts 80 and 90. Thus, it is possible to sufficiently shields crosstalk of noise generated in each signal line to adjacent signal lines. Accordingly, the cable side connector 50 exhibits good high-speed transmission characteristics.

(8) Capable of High-speed Signal Transmission in a Single Mode

Since the signal lines have a pseudo-coaxial structure in the entire length, in addition to a balanced transmission method, the cable side connector 50 can be applied to a method for transmitting separate high-speed signals where the signal lines on the upper surface and the signal lines on the lower surface immediately below are unrelated to each other. In other words, the cable side connector 50 can be applied to a method for transmitting high-speed signals separately to each signal line. Thus, the cable side connector 50 is capable of single mode transmission of high-speed signals of about 2 Gbps in addition to the balanced transmission method. In the case of the single mode transmission, it is possible to transmit information twice the size of the balanced transmission.

(Variation)

In the aforementioned embodiment, the printed board 60 has rigidity. However, a printed board having flexibility or a flexible flat cable may be used.

The present invention is not limited to the specifically disclosed embodiment, and variations and modifications may be made without departing from the scope of the present invention.

The present application is based on Japanese priority application No. 2005-277872 filed Sep. 26, 2005, the entire contents of which are hereby incorporated herein by reference.

What is claimed is:

1. A connector, comprising:

a shield cover;

a connector module housed in the shield cover;

an insertion portion disposed at a tip of the connector, the insertion portion being configured to be inserted into a destination connector and having signal contacts and ground contacts arranged therein, said destination connector being fixed upon a circuit substrate of an electronic apparatus; and a cable extending from a rear end of the connector, wherein:

the connector module includes a printed board, the signal contacts, and the ground contacts, the printed board includes a signal pattern and a ground pattern on a front face and a rear face thereof, the signal pattern having pads for signal contacts at an end thereof and the ground pattern having pads for ground contacts at an end thereof, the signal contacts are formed in accordance with the pads for signal contacts and fixed on the pads for signal contacts, the ground contacts are formed in accordance with the pads for ground contacts and fixed on the pads for ground contacts, and the insertion portion is formed at an end of the printed board, wherein:

the printed board includes a solid inner layer therein, a via for connecting the ground pattern on the front face, the ground pattern on the rear face, and the inner layer in an electrical manner, and a via for connecting the pads for ground contacts on the front face and the pad for ground contacts on the rear face in an electrical manner, said shield cover surrounding a tip end part of said printed board corresponding to said tip of said connector and forming, together with said solid inner layer, a pseudo-coaxial structure for each line of the signal pattern on the front face and for each signal contact on the front face and for each line of the signal pattern on the rear face.

2. The connector according to claim 1, wherein:

the signal contacts and the ground contacts both include rolled surfaces in upper surfaces thereof.

3. The connector according to claim 1, wherein:

the thickness of the ground contacts is greater than that of the signal contacts.

4. The connector according to claim 3, wherein:

the thickness of the ground contacts is greater than that of the signal contacts.

5. The connector according to claim 3, wherein:

the signal contacts and the ground contacts both include rolled surfaces in upper surfaces thereof.

* * * * *